United States Patent [19]

Wood

[11] 3,963,170

[45] June 15, 1976

[54] PANEL INTERLOCKING MEANS AND BLANK UTILIZING SAID MEANS

[75] Inventor: Prentice J. Wood, Jonesboro, Ga.

[73] Assignee: The Mead Corporation, Dayton, Ohio

[22] Filed: Nov. 29, 1974

[21] Appl. No.: 528,498

[52] U.S. Cl. ..... 229/40; 206/434; 229/48 R; 428/57

[51] Int. Cl.[2] ..... B65D 65/12; B65D 65/22

[58] Field of Search ..... 229/40, 48 R; 206/147–149, 152–158, 161; 428/33, 53, 57, 58, 133, 136

[56] References Cited

UNITED STATES PATENTS

| | | | |
|---|---|---|---|
| 3,367,557 | 2/1968 | Farquhar | 229/40 |
| 3,432,029 | 3/1969 | Brown | 229/40 X |

*Primary Examiner*—William Price
*Assistant Examiner*—Stephen Marcus
*Attorney, Agent, or Firm*—Walter M. Rodgers

[57] ABSTRACT

A unitary wrapper blank having top, bottom and side walls interconnected to form a tubular structure about a plurality of articles incorporates one composite wall formed of a pair of overlapping panels one of which incorporates at least one specially configured locking slit which receives a specially configured locking tab struck from the other lap panel after the locking tab is folded out of the plane of the other panel along a hinge line and into flat face contacting relation with an adjacent positioning tab formed on an edge of the other panel which tab also is inserted along with the locking tab into the locking slit. After the positioning tab and locking tab are fully inserted into the locking slit, the locking tab swings away from the positioning tab due to its inherent bias which tends to swing the locking tab into the plane of the panel from which it is struck.

13 Claims, 5 Drawing Figures

PANEL INTERLOCKING MEANS AND BLANK UTILIZING SAID MEANS

One known interlocking means for securing a pair of overlapping panels in interlocked relationship utilizes a locking tab having projections thereon which is driven bodily through a narrower locking aperture formed in the other panel. Such locking means characteristically performs a secure locking function and usually maintains the panels in tight interlocked relationship. Thus when an interlock of this type is used in conjunction with a wrapper type packaging blank, an efficient and secure packaging operation is effected. In order to form a lock using such known locking tabs and locking apertures, it is necessary as a practical matter to provide reciprocatory plungers for forming the lock. Since high speed packaging machines perform packaging manipulative operations while the blank and its contents are moved at high speed, the resulting machine for locking "punch-through" type locks becomes somewhat complicated if it is to perform an effective packaging operation.

Another known type of panel interlocking means utilizes complicated so-called "heel and toe" locking means in one panel which must be manipulated in precise synchronism with corresponding apertures formed in the other panel and such manipulative operations require a high degree of precision and frequently are characterized by a degree of overtravel which, when the locking operation is completed, allow the lock components to relax somewhat and thereby result in loosening and insecurity of wrapper type packages.

According to this invention an improved panel interlocking means and method are provided which dispense with complicated high speed moving components which customarily are required to perform a locking operation of the punch-through type. With respect to "heel and toe" locks, the high degree of precision is avoided and the tendency of the interlocked panels to relax due to overtravel is virtually eliminated. More specifically and in accordance with one form of this invention, one panel to be interlocked with another panel is provided with a locking slit which includes a base slit together with locking edges which diverge from the ends of the base slit in a direction away from the direction of locking movement of the panel to be interlocked together with a positioning tab formed on the edge of the other panel to be interlocked which is disposed adjacent a locking tab struck from the other panel and folded into flat face contacting relation with the positioning tab. Thereafter, both the positioning tab and the locking tab are inserted into the locking slit by generally parallel motion of one panel relative to the other panel so that after a predetermined degree of overlap which is determined by engagement of the positioning tab side edges with the ends of the locking edges of the locking slit, the locking tab swings outwardly and occupies an angular position relative to the positioning tab thereby to effect a secure interlocked relationship between the two panels which effectively precludes relative motion therebetween in the planes thereof in any direction.

For a better understanding of the invention reference may be had to the following detailed description taken in conjunction with the accompanying drawings in which FIG. 1 is a perspective view of a completed package formed according to this invention and which is shown upside down from its normal orientation in order to depict the interlocking means which normally aids in forming a composite bottom panel;

FIG. 4 is a view similar to FIG. 3 and which shows the panels and their locking elements in interlocking relationship; and in which

Figure 2:
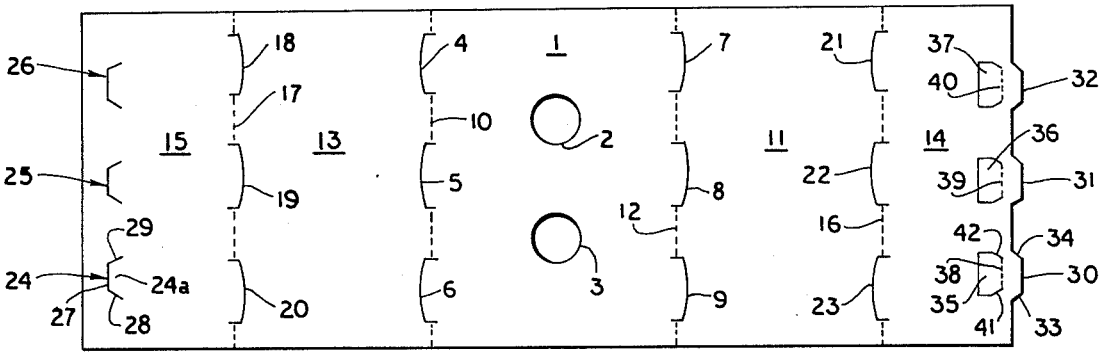
FIG. 2 is a plan view of a blank from which the package shown in FIG. 1 is formed.

In the drawings the numeral 1 designates the main central panel of the blank which ordinarily constitutes the top wall of the finished package but which in FIG. 2 appears as the bottom wall since FIG. 2 shows the package upside down from its normal orientation. In panel 1, a pair of finger gripping apertures 2 and 3 are formed in known manner and facilitate carrying the package. A plurality of corner slits of known construction are formed in the wrapper and are designated by the numerals 4–9 inclusive. As is well known corner slits 4, 5 and 6 are disposed generally along the fold line 10 by which side wall 13 is foldably joined to a side edge of main panel 1. Similarly corner slits 7, 8 and 9 are formed along fold line 12 by which side wall 11 is foldably joined to a side edge of main wall panel 1. As is well known, corner slits 4-9 inclusive receive portions of the packaged article such as cans C and aid in retaining the cans against dislodgment through the open ends of the tubular structure.

A composite wall panel comprises a pair of lap panels designated by the numerals 14 and 15 which are foldably joined to side walls 11 and 13 respectively along fold lines 16 and 17. These lap panels 14 and 15 are interlocked according to this invention and are sometimes referred to herein as interlocked panels or as lap panels.

Corner slits 18, 19 and 20 are formed along fold line 17 while similar corner slits 21, 22 and 23 are formed along fold line 16 and function in known manner to aid in retaining the cans C within the wrapper.

Panels 14 and 15 are interlocked according to one form of this invention by means of locking slits such as are formed in panel 15 and designated by the numerals 24, 25 and 26. Each locking slit includes a base slit such as 27 and a pair of locking edges designated on slit 24 by the numerals 28 and 29 which define a guide tab 24*a*. These locking edges 28 and 29 are arranged so that their near ends interconnect with the ends of base slit 27 and so that their opposite ends diverge in a direction away from the portion of lap panel 15 which is to be overlapped with lap panel 14 and which also diverge in the general direction of the main portion of lap panel 15 and in a direction opposite from the general direction of planar locking movement of panel 15 toward panel 14.

The other panel to be overlapped is designated by the numeral 14 and is provided along its end edge with a plurality of positioning tabs designated by the numerals 30, 31 and 32. Each of these positioning tabs is provided as is indicated in connection with tab 30 with a pair of outwardly convergent side edge portions designated by the numerals 33 and 34. In addition and in accordance with a feature of this invention, a plurality of locking tabs generally designated by the numerals 35, 36 and 37 are struck from the panel 14 and are foldably joined thereto by their respective hinge lines 38, 39 and 40. Each locking tab such as 35, 36 and 37 is provided with angularly related side edge portions such as are designated by the numerals 41 and 42 in connection with locking tab 35. Preferably the locking tab 35 is aligned with positioning tab 30 and the hinge line 38 is parallel with the end edge of positioning tab 30. The locking tab 35, as disposed in the blank, extends in a direction opposite to the outwardly projecting positioning tab 30 and is of such length that tab 35 projects beyond the end edge of tab 30 when folded to the position shown in FIG. 3. The angularly related side edges 41 and 42 of tab 35 intersect the hinge line 38.

Figure 1:
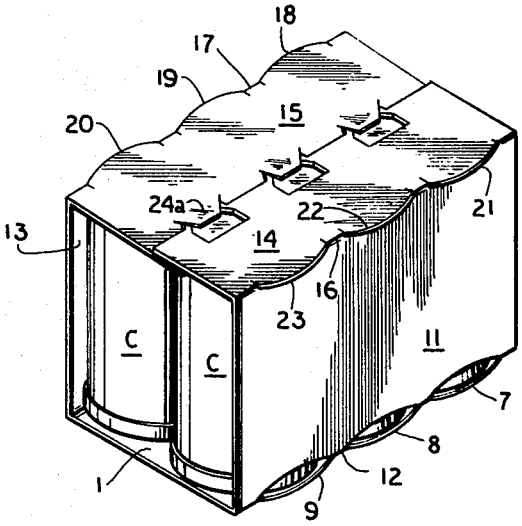

In order to form the package shown in FIG. 1 from the blank shown in FIG. 2, the main panel 1 is disposed in contact with corresponding ends of the cans "C" and the side wall 11 and 13 are folded alongside the cans as is well known. Thereafter the lap panels 14 and 15 are folded along their respective fold lines 16 and 17 into positions of approximate contact with the ends of the cans C which are opposite from the ends which are in contact with main panel 1. Thereafter the panels 14 and 15 are secured together in interlocking relationship according to this invention.

Figure 3:
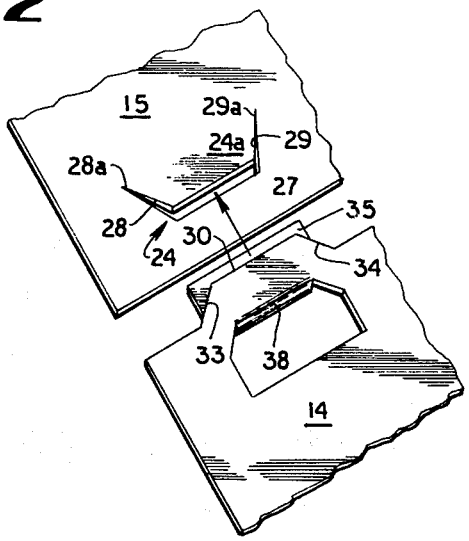
FIG. 3 is an enlarged fragmentary view of portions of two panels which are interlocked according to this invention and which show the interlocking elements and the panels as these components appear during an intermediate stage of an interlocking operation.

The fragments of panels 14 and 15 which are shown in FIG. 3 and which incorporate locking slot 24 and its associated guide tab 24*a* are moved toward each other in parallel planes after the locking tab 35 is driven downwardly out of the plane of panel 14 and folded along its hinge line 38 into flat face contacting relation with the positioning tab 30. With guide tab 24*a* elevated slightly as shown in FIG. 3, locking tab 35 is disposed in overlying flat face contacting relationship with respect to the adjacent edge portion of panel 15 and is interposed between positioning tab 30 and the adjacent edge portion of panel 15. Continued movement of panels 14 and 15 toward each other in approximately parallel planes and with the guide tab 24*a* slightly elevated as shown in FIG. 3 causes both the positioning tab 30 and the locking tab 35 to slide underneath the guide tab 24*a*. The degree of overlap which is to be effected is determined by engagement of side edge 33 of positioning tab 30 with the end 28*a* of locking edge 28 and by engagement of side edge 34 of positioning tab 30 with the end 29*a* of locking edge 29.

Figure 5:
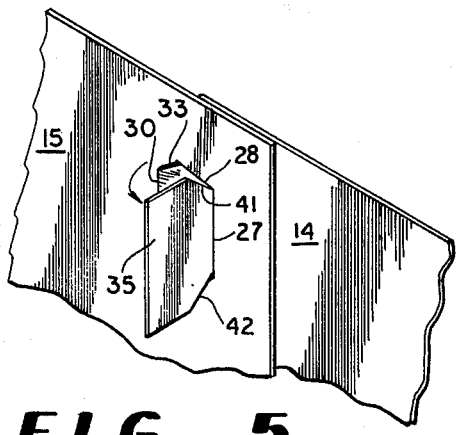
FIG. 5 is a view of the structure shown in FIG. 4 but which depicts the underneath surfaces of FIG. 4.

During movement of positioning tab 30 and of locking tab 35 into locking slit 24, locking tab 35 is disposed in flat face contacting relationship with respect to positioning tab 30. After the parts occupy their fully overlapped position with edges 33 and 34 in engagement of the ends 28*a* and 29*a* respectively of locking edges 28 and 29, locking tab 35 swings downwardly as viewed in FIG. 3 and in a direction away from positioning tab 30 due to the inherent bias or "fight" of the material which constitutes panel 14 and which is effective to cause locking tab 35 to occupy an angular position relative to panels 14 and 15 as is shown in FIG. 5. When so disposed, side edge portion 41 of locking tab 35 is in engagement with locking edge 28 and side edge portion 42 of locking tab 35 is in engagement with locking edge 29 not shown in FIG. 5 since this edge is disposed behind locking tab 35.

Figure 4:
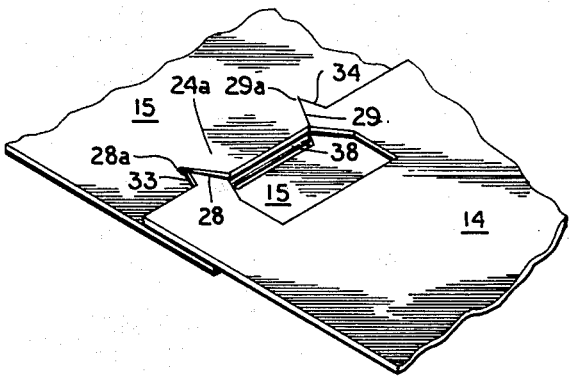

When the lock is completed as is shown in FIGS. 4 and 5, panels 14 and 15 are effectively locked against movement in the planes thereof in any direction. For example as depicted in FIGS. 4 and 5, panel 14 is precluded from moving to the left relative to panel 15 due to engagement of side edge 33 of positioning tab 30 with the end 28*a* of locking edge 28 and by side edge portion 34 of positioning tab 30 which engages end 29*a* of locking edge 29. Up and down motion of panel 14 relative to panel 15 is prevented as shown in FIG. 5 because of the angular disposition of locking tab 35 relative to panel 15 and due to the fact that hinge line 38 of locking tab 35 is approximately equal to the length of base slit 27 so that relative vertical motion of panels 14 and 15 is prevented.

Motion of panel 14 toward the right as viewed in FIG. 5 relative to panel 15 is precluded by engagement between side edge portions 41 and 42 of locking tab 35 with the portions of locking edge 28 and 29 which are adjacent to base slit 27.

Thus as is apparent, panels 14 and 15 are effectively secured together in fixed overlapping relationship according to the invention. Furthermore as panels 14 and 15 are drawn toward each other from the position shown in FIG. 3 to that shown in FIG. 4, the fully overlapped condition of the panels is determined and virtually no relaxation occurs after the lock is formed, as shown in FIGS. 4 and 5. Since the parts do not change positions after the desired degree of overlap is achieved, swinging movement of lap panel 35 out of its position of face contacting relationship with positioning tab 30 and into the position shown in FIG. 5, completes the package and forms a secure interlock according to this invention with little, if any, relaxation in wrapper tension.

Interlocking of positioning tabs 31 and 32 with locking slots 25 and 26 respectively and via locking tabs 36 and 37 respectively is effected in a manner identical to the locking action of positioning tab 30, locking slot 24 and locking tab 35.

It is apparent that no reciprocatory machine parts are required to effect this lock and that the lock may be formed completely by static guides which engage the various components and which perform manipulative operations as is obvious from the nature of the interlocking means and method according to this invention following swinging movement of locking tab such as 35 out of the plane of panel 14 and the slight movement of guide tabs such as 24*a* out of the plane of panel 15 which movements can be effected readily by rotary radial elements which are well known in the art.

The embodiments of the invention in which an exclusive property or privilege is claimed are defined as follows:

1. An arrangement for interlocking a pair of panels in overlapping relation, said arrangement comprising a locking slit formed in one of said panels and having a pair of spaced angularly related locking edges which diverge from a base slit, a locking tab struck from a part of the other of said panels and having a pair of spaced angularly related side edge portions and being secured to said other panel along a hinge line which is disposed in substantial coincidence with said base slit, and part of said other panel from which said locking tab is struck being disposed in a direction from said base and hinge lines which is opposite to that in which said locking edges extend, said locking tab being folded out of the plane of said other panel and being disposed within said locking slit with its angularly related side edge portions in locking engagement respectively with said angularly related locking edges of said locking slit, and said locking edges and said side edge portions being secured in angular locking relation to each other by the inherent bias urging said locking tab toward coplanar relationship with said other panel.

2. An arrangement according to claim 1 wherein an edge of said other panel adjacent said locking tab is configured to define a positioning tab which is disposed within said locking slit and which tends to hold said panels in face contacting relation to each other.

3. An arrangement according to claim 2 wherein said positioning tab is defined by outwardly converging side edges which engage the inwardly divergent ends of said locking edges of said locking slit respectively to determine the degree of overlap of the edge portions of the panels.

4. An arrangement according to claim 1 wherein corresponding ends of said angularly related locking edges are interconnected with the ends of said base slit and diverge therefrom.

5. An arrangement according to claim 4 wherein said locking edges diverge from each other in the general direction of said one panel and away from said base slit and from the overlapped edge portion of said one panel.

6. An arrangement according to claim 4 wherein said base slit and said angularly related locking edges define a guide tab formed integrally with said one panel.

7. An arrangement according to claim 1 wherein corresponding ends of said side edge portions of said locking tab intersect the ends of said hinge line respectively and diverge therefrom.

8. Interlocking means for securing in overlapping relation a pair of panels each having an edge portion, said interlocking means comprising a locking slit formed in one of said panels and having a base slit generally parallel to the edge portion of said one panel and having locking edges diverging from the ends of said base slit in a direction generally away from the edge portion of said one panel, a positioning tab formed on the edge portion of the other of said panels and disposed within said locking slit, a locking tab struck from the other of said panels and joined thereto along a hinge line generally parallel to the edge portion of the other of said panels, said locking tab being positioned out of the plane of the other panel and having side edge portions which diverge from its hinge line, and said locking tab extending through said locking slit with its hinge line adjacent said base slit and with its side edges in locking engagement respectively with said locking edges of said locking slit.

9. Interlocking means according to claim 8 wherein locking engagement of said side edges of said locking tab with said locking edges is maintained by the inherent tendency of said locking tab to swing toward the plane of said other panel from which it is struck.

10. An arrangement for interlocking a pair of panels in overlapping relation, said arrangement comprising a locking slit formed in one of said panels and having a base slit and a pair of spaced angularly related locking edges, a locking tab struck from the other of said panels and having a pair of spaced angularly related side edge portions and being secured to said other panel along a hinge line, said locking tab being folded out of the plane of said other panel and being disposed within said slit with its angular related side edge portions in locking engagement respectively with said angularly related locking edges of said locking slit, said locking edges and said side edge portions being secured in angular relation of each other by the inherent bias urging said locking tab toward coplanar relationship with said other panel, corresponding ends of said angularly related locking edges being interconnected with the ends of said base slit and being divergent therefrom, said hinge line being in approximate registry with said base slit and said locking tab being struck from a portion of said other panel which is disposed on the side of said hinge line and of said base slit which is in the direction opposite from the direction in which said angularly related locking edges extend.

11. An arrangement for interlocking a pair of panels in overlapping relation each panel having an edge portion, said arrangement comprising a locking tab struck from one of said panels and having a pair of spaced angularly related side edge portions and being secured to said one panel along a hinge line, a locking slit formed in the other of said panels and having a pair of angularly related locking edges, said locking tab being folded out of the plane of said one panel and being disposed within said slit with its angularly related side edge portions in locking engagement respectively with said angularly related locking edges of said locking slit, said locking tab struck from a part of said one panel which is disposed in a direction from said hinge line away from said edge portion of said one panel, and said locking edges and said side edge portions being secured in angular relation to each other by the inherent bias urging said locking tab toward coplanar relationship with said one panel.

12. An article carrier blank of the wraparound type comprising a main panel, side wall panels foldably joined respectively to opposite side edges of said main panel, lap panels foldably joined respectively to edges of said side panels remote from said main panel, at least one locking slit formed in one of said lap panels and having a base slit parallel to an edge thereof remote from the associated side wall and including a pair of locking edges diverging from said base slit in a direction away from the adjacent end edge of the blank and of said one lap panel, and a locking tab struck from the other of said lap panels and foldably joined thereto along a hinge line generally parallel to the adjacent end edge of the blank and of said other lap panel, said locking tab being struck from a part of said lap panel which is between its hinge line and the junction between the associated lap panel and side wall and said locking tab having side edge portions which diverge in a direction away from said hinge line and toward the junction between the associated lap panel and side wall.

13. A blank according to claim 12 in which a positioning tab is formed on the end edge of the blank adjacent said hinge line of said locking tab and adjacent thereto.

* * * * *

UNITED STATES PATENT OFFICE

CERTIFICATE OF CORRECTION

PATENT NO. : 3,963,170

DATED : June 15, 1976

INVENTOR(S) : Prentice J. Wood

It is certified that error appears in the above-identified patent and that said Letters Patent are hereby corrected as shown below:

Column 4, line 59 cancel "and" and insert therefor - said -

Signed and Sealed this

Twelfth Day of April 1977

[SEAL]

*Attest:*

RUTH C. MASON
*Attesting Officer*

C. MARSHALL DANN
*Commissioner of Patents and Trademarks*